United States Patent [19]

Liou

[11] Patent Number: 4,561,507

[45] Date of Patent: Dec. 31, 1985

[54] TOOL ADAPTER

[76] Inventor: Mou T. Liou, No. 33, Hsi-Fu Rd., Da-Li Hsian, Taichung Hsieng, Taiwan

[21] Appl. No.: 586,737

[22] Filed: Mar. 6, 1984

[51] Int. Cl.[4] ..... B25D 15/00

[52] U.S. Cl. ..... 173/93.7; 173/93; 279/14

[58] Field of Search ..... 193/93, 93.7; 145/30 R, 145/30.5, 53, 61 F; 279/1 DC, 1 ME, 1 DA, 14

[56] References Cited

U.S. PATENT DOCUMENTS

| | | | |
|---|---|---|---|
| 2,559,558 | 7/1951 | Carlson et al. | 173/93.7 |
| 2,638,806 | 5/1953 | Spielman | 173/93.7 |
| 3,054,312 | 9/1962 | Zengerer | 173/93.7 |
| 3,975,031 | 8/1976 | Bennett | 279/14 X |

FOREIGN PATENT DOCUMENTS

| | | | |
|---|---|---|---|
| 682567 | 11/1952 | United Kingdom | 173/93.7 |

*Primary Examiner*—E. R. Kazenske
*Assistant Examiner*—William Fridie, Jr.
*Attorney, Agent, or Firm*—Fitzpatrick, Cella, Harper & Scinto

[57] ABSTRACT

An impact screw driver which includes two changeable coupling ends of variable sizes to be inserted into differently dimensioned coupling sleeve heads of the tool bits, thereby facilitating the manufacture of the device.

3 Claims, 5 Drawing Figures

TOOL ADAPTER

BACKGROUND OF THE INVENTION

This invention relates to a tool adaptor, particularly to one which features two differently sized coupling ends that can be changeably coupled to differently sized coupling sleeve heads of tool bits.

There have existed various forms of tool adapters for coupling to tools. As shown in FIG. 1, an impact screw driver typically includes an impact receiving member 1 that imparts a rotary motion to a transmitting unit or adapter 2 through a cam mechanism (not shown) and the transmitting unit 2 usually has a coupling end 2*a* of square or hexagonal cross-section integrally formed therewith. The coupling end 2*a* is adapted for being fitted in the coupling sleeve head 3 of the tool bit 4, such as, a wedge-shaped screw driver blade or philliphs-head, cross slotted screw driver, by means of the engagement of a spring biassed ball.

Generally, the coupling sleeve head 3 is manufactured in two specifications, $\frac{3}{8}$ inches and $\frac{1}{2}$ inches, and to match the sizes of the coupling sleeve head, the impact screw driver usually has a $\frac{3}{8}$ or $\frac{1}{2}$ inch coupling end. In some cases, inconveniences are caused to the manufacturers in processing different sized tools to supply their clients whose requirements are not uniform.

SUMMARY OF THE INVENTION

An object of the invention is to provide an impact screw driver with an adapter which has two changeable coupling ends of different dimensions for insertion into different dimensioned coupling sleeve heads of the tool bits.

The foregoing and other objects can be achieved in accordance with the invention through the provision of an impact screw driver which includes an impact receiving member having a first axial bore provided at one end, and a transmitting unit having a rotary member which is mounted in said first bore, a cam mechanism for transmitting the axial motion of said impact receiving member to said rotary member as a rotary motion. The impact screw driver has improvements in that the rotary member is provided with a second axial bore at its other end, said second bore having an enlarged cross-section portion and a deeper coaxial contracted cross-section portion. A coupling body is detachably fitted in said second bore and has first and second portions of differently sized cross-sections. The first and second portions are capable of being received in said enlarged and contracted cross-section portions respectively, said first portion being greater in length than said second portion. Therefore, the enlarged portions and contracted portions can be changeably fitted in said second bore for offering two differently sized coupling ends for insertion into the coupling heads of tool bits.

The presently preferred exemplary embodiment will be described in detail with reference to the following drawings.

DETAILED DESCRIPTION OF THE PREFERRED EMBODIMENT

Figure 1:
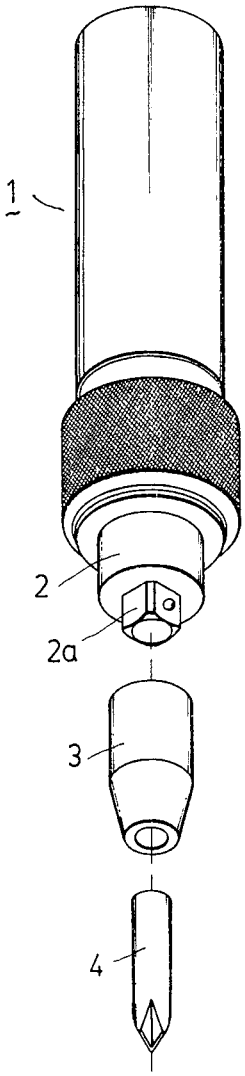
FIG. 1 is a schematic view of an impact screw driver according to the prior art.
Figure 2:
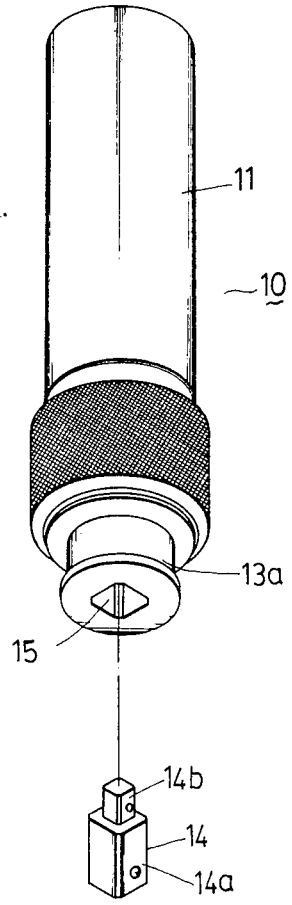
FIG. 2 is a schematic view of an impact screw driver in accordance with the invention.
Figure 3:
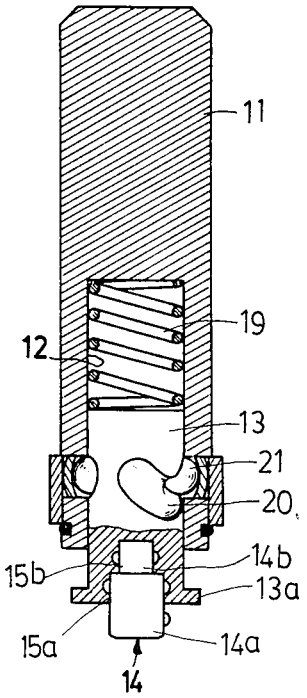
FIG. 3 is a sectioned view of an impact screw driver of the embodiment of FIG. 2.

Referring to FIGS. 2 to 5, an impact screw driver 10 includes an impact receiving cylindrical member 11 which is provided with an axial bore 12 for receiving a transmitting unit. The transmitting unit includes a rotary member 13 having a slightly enlarged end 13*a* and provided with a second axial bore 15 receiving a coupling body 14 of square-shaped cross-section. The coupling body 14 includes an enlarged portion 14*a*, preferably $\frac{1}{2}$ inches in its cross-section and a contracted portion 14*b*, preferably $\frac{3}{8}$ inches in its cross-section, the portion 14*a* being also greater in length than the portion 14*b*.

Figure 5:
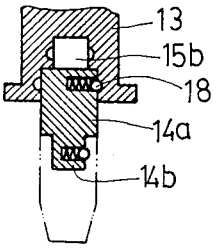
FIG. 5 is a view illustrating that the enlarged portion is received in the second bore and the contracted portion is projected outward as a coupling end.
Figure 4:
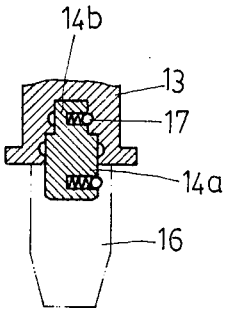
FIG. 4 is a view illustrating that the contracted portion is received in the second bore and the enlarged portion is projected outward as a coupling end.

The second axial bore 15 has an enlarged square-shaped cross-section portion 15*a* which is similar in cross-section to but smaller in length than the portion 14*a* of the coupling body 14, and a deeper coaxial square shaped cross-section portion 15*b* conforming to the size of the portion 14*b* of the coupling body 14. Therefore, as shown in FIG. 4, when the portion 14*b* of the coupling body is received in the portion 15*b* of the second bore and retained by the spring biassed ball 17, a portion of the portion 14*a* is projected outward as a coupling end for insertion into the coupling sleeve head 16 of the tool bit. As shown in FIG. 5, when the portion 14*a* of the coupling body 14 is received and retained by the spring biassed ball 18, the portion 14*b* is projected outward as a coupling end.

As can be appreciated conventionally, the rotary member 13 will impart a torque to the coupling sleeve head 16 when the impact receiving body 11 is hammered. The axial movement of the body 11 is transmitted to the rotary member 13 as a rotary motion through a known cam mechanism including a spring 19, cam grooves 20, and a ball 21. As the cam mechanism is known in the art the details thereof are not herein described.

With the invention thus explained, it is apparent that obvious modifications and variations can be made without departing from the scope of the invention. It is therefore intended that the invention be limited only as indicated in the appended claims.

I claim:

1. In an impact tool including an impact receiving member having a first axial bore provided at its one end; and a transmitting unit having a rotary member which has its one end mounted in said first bore, a cam mechanism for transmitting the axial motion of said impact receiving member to said rotary member as a rotary motion, the improvements wherein said rotary member is provided with a second axial bore at its other end, said second bore having a portion of a first lateral dimension and a deeper and coaxial portion of a second smaller lateral dimension, and a coupling body which is detachably fittable in said second bore and having first and second portions of differently cross-sections dimensions, said first and second portions of said coupling body being capable of being fitted in said first and second portions, respectively, of said second axial bore, said first portion being greater in length than said second portion, whereby said first and second portions of said coupling body can be changeably fitted in said second bore for presenting two differently sized coupling ends for insertion into the coupling heads of tool bits.

2. An adapter for transmitting torque to a tool including a driven member having a first axial bore provided at its one end, and a transmitting unit having a rotary member one end of which is received in said first bore and a second axial bore at its other end, said second bore having a first portion and a deeper coaxial second portion of smaller lateral dimension than said first portion, and a coupling body which is detachably fittable in said second bore and having first and second portions of different lateral sizes, said first and second portions of said coupling body being capable of being fitted in said first and second portions of said second bore, respectively, the larger portion of said coupling body being greater in length than the smaller portion thereof, whereby said respective portions of said coupling body can be changeably fitted in said second bore for providing two differently sized coupling ends for insertion into the coupling heads of tool bits.

3. An impact tool as claimed in claim 1, wherein said first and second portions of said coupling body are square-shaped in their cross-sections and the dimensions of said first and second portions of said coupling body portions are $\frac{1}{2}$ inches and $\frac{3}{8}$ inches, respectively.

* * * * *